United States Patent [19]

Kuck

[11] 4,432,483

[45] Feb. 21, 1984

[54] SAFETY RELEASE MECHANISM FOR FASTENING DEVICES

[75] Inventor: Manfred Kuck, Ahrensburg, Fed. Rep. of Germany

[73] Assignee: Joh. Friedrich Behrens AG, Ahrensburg, Fed. Rep. of Germany

[21] Appl. No.: 357,583

[22] Filed: Mar. 12, 1982

[51] Int. Cl.[3] ..... B21J 7/20

[52] U.S. Cl. ..... 227/8; 222/153; 227/130; 239/525

[58] Field of Search ..... 227/1, 8, 130; 239/525–528, DIG. 22; 222/389, 402.11, 402.15, 153; 124/40, 31, 80, 74; 176/169

[56] References Cited

U.S. PATENT DOCUMENTS 3,713,573 1/1973 Fehrs ..... 227/8

4,194,664 3/1980 Siegmann ..... 227/8

*Primary Examiner*—E. R. Kazenske

*Assistant Examiner*—Douglas D. Watts

*Attorney, Agent, or Firm*—Emrich, Lee, Brown & Hill

[57] ABSTRACT

The present invention relates to a safety release mechanism for use with a power operated driving apparatus for fasteners which includes a pivotally supported trigger or release lever housing for actuating or releasing the driving apparatus upon engagement with a release pin or switch. The safety release mechanism is supported in the trigger housing between the trigger and the release pin and is biased by a spring to the safety or off position which prevents the trigger lever from engaging the release pin. Upon movement of the safety release member to the actuated or release position, the trigger lever is engageable with the release pin or switch to actuate the power operated driving apparatus.

9 Claims, 3 Drawing Figures

SAFETY RELEASE MECHANISM FOR FASTENING DEVICES

BACKGROUND OF THE INVENTION

Power operated driving apparatuses for fasteners, energized, for example by compressed air, generate substantial driving forces. Therefore, if a fastener is not driven into the workpiece, the fastener may, upon exiting the apparatus, resemble a projectile which may injure the operator or other persons present in the neighborhood. Safety regulations, therefore, prescribe that such projectiles must be avoided. One attempt to eliminate these projectiles is to associate with the muzzle of the driving apparatus a sensor element which only permits an energization or release of the driving apparatus when the muzzle to the driving apparatus has been placed in contact with the workpiece. Accordingly, there have been numerous proposals of construction as to how the sensor is to be designed and in what way it prevents release of the driving apparatus as long as the sensor has not been actuated directly by the workpiece. However, sensors suffer from the disadvantage that they substantially enlarge the muzzle of the driving apparatus thereby rendering difficult the exact positioning of the fastener on the workpiece. Additionally, a sensor is unsuited for work of a type where fabrics or the like are to be tucked, as may be the case in upholsteries.

It has therefore become known to associate a release safety means directly to the release lever of the driving apparatus. In such a structure, the release means is pivotally supported about the release lever of the driving apparatus and includes a spring-biased safety or secondary lever having a downward extension which lies in close contact against the release lever and prevents the actuation thereof. Only when the secondary lever is pivoted may the release lever be actuated (German disclosure letter No. 29 23 987). The pivotal movement of the secondary lever preceding the release of the driving apparatus is to be considered as being disadvantageous from a design standpoint. Also, the safety feature resulting from this type of known release means is only conditionally provided because the release lever and the safety lever possess the same direction of actuation. Therefore, in case of an inadvertent contact by the operator or through a dropping movement of the apparatus and impingement thereof on an article, the release means may be readily overcome and the driving apparatus may be energized. Additionally, such release means cannot be readily incorporated in existing driving apparatus.

It has been suggested also to utilize a release safety means in a compressed air operated fastener driving apparatus. Such safety means include positioning a safety valve in the air passage between the release valve and the control valve. While the release valve is operated by the release lever, the safety valve is actuated by an element pivotally supported above the release lever which is connected to a handling means released by the thumb of the actuating hand. When operating such driving apparatus, the element must first be held against the safety valve through actuation by the thumb before the control valve may be triggered through an actuation of the release valve (German patent letter No. 28 11 339). However, such structures are very costly because of the requirement of an additional valve and are further disadvantageous because of the air consumption by the safety valve, because compressed air escapes through the safety valve when the release lever has already been actuated but the safety valve has not yet been closed. Moreover, the insertion of a safety valve within an existing driving apparatus is not readily accomplished and the thumb operation of such safety means is relatively difficult to accomplish. Accordingly, such safety means are not readily available and have been commercially unacceptable.

SUMMARY OF THE INVENTION

It is one object of the present invention to provide a safety release mechanism or means for a power operated fastener driving apparatus which safely prevents inadvertent release of the apparatus but which may be readily released by the operator with the use of one hand. The invention furthermore results in a minimum of additional costs in terms of material and mounting expenditure and may also be incorporated in existing fastener driving apparatus with a minimum of cost and labor.

Another object of the present invention is that the trigger or release lever is designed in the form of a channel, in a known manner, and the safety mechanism or means is displaceably supported within the channel of the trigger lever. The safety release mechanism is provided with a depression, or opening formed therein which is aligned with the release or pin apparatus switch and which is biased in such a manner that in the safety or off position, the opening therein is aligned with a depression or recess in the trigger lever to prevent the depressed trigger lever from engaging a release pin or switch which actuates the driving apparatus.

In the present invention, the safety release mechanism consists of two parts which are displaceable relative to each other. In the safety or off position predetermined by the spring biased safety mechanism, a quasi free-wheeling effect is obtained in such a manner that the actuation of the trigger or release lever does not result in actuation of the release pin. The release pin, for example, may consist of a release valve for a compressed air-operated fastener driving apparatus, with the release and pilot control valve being advantageously designed in the manner according to the German patent letter No. 1 478 805. Also, with respect to electromagnetically operated fastener driving apparatus, such devices may be equipped with the safety release mechanism according to the present invention in the same manner, with the release pin actuating an electric starting switch. The free-wheeling effect in the case of the safety release mechanism, according to the present invention, results when the depression or recess formed in the trigger or release lever, which accommodates the release pin, and the opening in the safety lever portion of the safety mechanism are aligned together. If, however, the safety lever portion is displaced relative to the trigger lever, the release pin is engaged and actuated by the trigger lever.

The extension portion or element of the safety mechanism projects outwardly from the trigger or release lever and is ideally arranged from a design standpoint. When gripping the handle portion of the driving apparatus and the trigger lever, upon a squeezing of the operator's hand, the trigger lever moves inwardly and the extension portion is contacted with the aid of an advanced forefinger on the hand and thereby the safety lever portion is displaced or moved, so that immediately following actuation of the trigger or release lever, the trigger lever will engage the release pin and actuate the driving apparatus. However, such movement provides that the safety release mechanism irreproachably provides security against inadvertent actuation of the driving apparatus. The safety mechanism provides that the direction of actuation of the safety mechanism, on the one hand, and the trigger or release lever on the other hand are offset by approximately 90 degrees from each other. Thus, the safety requirement standard is met because the safety mechanism must be moved through a predetermined distancy before the actuation of the driving apparatus may be effected.

The additional expenditure which is connected with the safety release mechanism according to the present invention is extremely low. The mechanism consists of a safety element which is displaceably supported within the channel of the trigger lever, and a spring for biasing the safety element to the at rest-off position. These parts are simple to manufacture and may easily be incorporated in driving apparatus. In addition, they may also be fitted later on an existing fastening apparatus, so that it is possible to adapt existing driving apparatus to provide greater safety provisions.

According to one embodiment of the present invention, the safety mechanism to be bent approximately into an L-shape element and is formed of a flat strip of sheet metal. For the actuation of the safety element, it is advantageous to provide that the extension portion of the safety mechanism is slightly bent in a direction away from the axis of the muzzle of the driving apparatus. This permits the back of the forefinger of the operator's hand, when gripping the apparatus, to effectively engage and move the extension portion of the safety mechanism.

The length of the extension portion of the safety mechanism preferably corresponds approximately to the thickness of a forefinger. Also, the extension portion may also be configured to be shorter or longer, as desired. The optimun length is a compromise between easy actuation and possible obstruction in the handling of the driving apparatus.

According to another embodiment of the present invention, the width of the safety mechanism approximately corresponds to the width of the channel in the trigger or release lever housing. Thereby, the safety mechanism is effectively guided within the channel of the housing and need not be additionally fastened thereto, but may rather be merely placed loosely into the channel. This design feature greatly facilitates the mounting operation of the safety mechanism to the driving apparatus.

If it is desired that the safety mechanism require as little space as possible, provision is made in the present invention for the actuation portion to be movable within an opening in the bottom of the trigger or release lever channel. The bottom of the release lever channel may be provided with a recess at the side facing the shooting channel or muzzle and the actuation portion may move between a safety-off position to a second actuating position.

In still another embodiment of the present invention, provision is made for the safety mechanism to extend only part of the length of the trigger or release lever housing and to be attached to a tension spring at the end opposite from the actuation portion of safety mechanism. The tension spring is anchored to the trigger lever housing. The tension spring biases the safety mechanism to the at rest-off position in which the opening in the safety mechanism is aligned with the depression in the trigger lever.

Additionally, in order that the tension spring will not become visible from outside or otherwise be obstructively projecting, it is preferred that the channel of the trigger housing extend approximately the entire length of the release lever and cover the tension spring.

What has been described is a novel safety release mechanism according to the present invention which is of simple design and which may be readily and inexpensively attached to desirous types of fastener driving apparatus. The safety mechanism is arranged optimally from a design standpoint and permits the one-handed operation on the part of the operator to release the safety means. When the opening in the safety mechanism and the depression in the trigger lever are sufficiently misaligned, actuation of the release pin and the fastener driving apparatus occurs.

DETAILED DESCRIPTION

Figure 1:
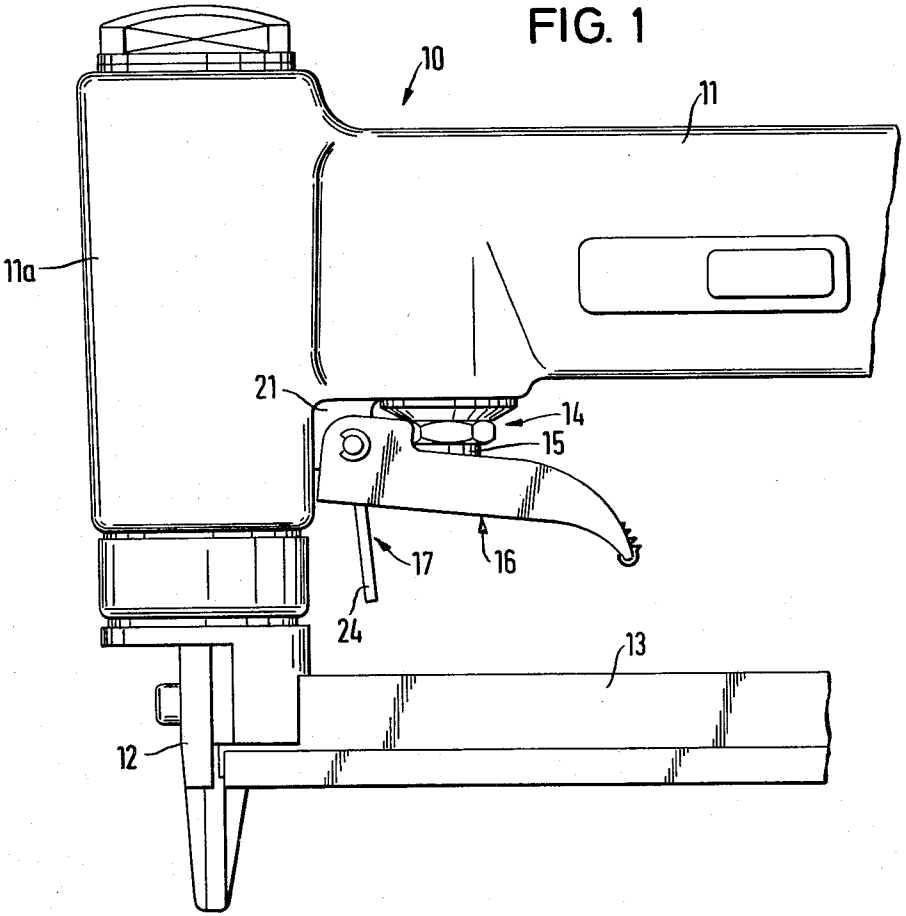
FIG. 1 is a side elevational view of a compressed air operated fastener driving apparatus in accordance with the present invention.

Before enlarging in more detail on the individual representations in the drawings, it is pointed out that each feature is of inventive importance in and of itself. Referring now to the drawings wherein like numerals have been used throughout to indicate the same or similar parts, in FIG. 1 a compressed air operated driving apparatus 10 is shown which is adapted to propel a fastener, staple or the like into a workpiece. The fastening apparatus 10 is intended to include air compression, electromagnetic and mechanical type driving apparatus which drive a fastener into the workpiece.

The apparatus 10 includes a handle portion 11, a cylinder housing **11*a* connected to the handle portion, a mouthpiece 12 fitted at the underside of the cylinder housing as well as a magazine 13 for the fasteners connected to the cylinder housing 11*a*. The handle portion 11 is provided with a compressed air reservoir, as is well known in the art, and simultaneously supports a release valve 14 which is provided with a downwardly projecting release pin 15. Arranged in the cylinder housing 11*a* is a driving cylinder with a driving piston (not shown). Connected to the driving piston is a driving plunger (not shown) which is guided in a shooting channel or muzzle which may have fasteners supplied thereto via the magazine in a manner that is known. Actuation of the release valve 14 is by a trigger or release lever 16 which has associated thereto a safety mechanism 17** which provides the safety release feature of the present invention.

Figure 2:
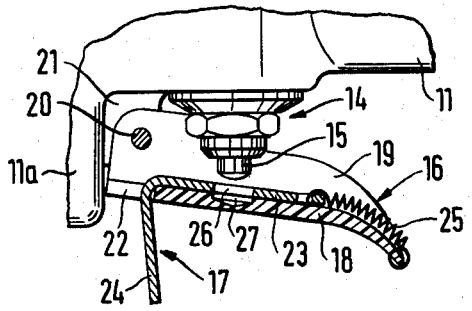
FIG. 2 is a sectional view taken of the trigger lever and safety mechanism in the at rest-off position in accordance with the present invention.
Figure 3:
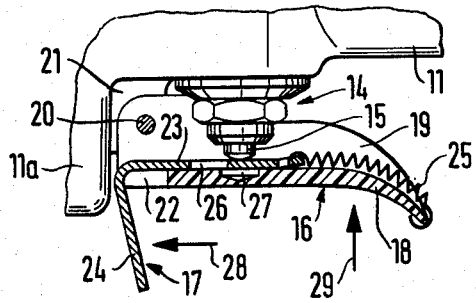
FIG. 3 is a sectional view taken of the trigger lever and safety mechanism in the actuating position in accordance with the present invention.

Referring now to FIGS. 2 and 3, the safety mechanism 17 in accordance with the present invention is described. Specifically, the trigger or release lever 16 is comprised of a housing having an approximately U-shaped cross sectional shape. The housing has a bottom portion 18 and two parallel leg portions pointing upwards formed integrally with the bottom portion 18, one of them being shown at 19. The leg portions 19 are pivotally fastened to an extension of the apparatus 10 in the region adjacent to the cylinder housing 11*a* by a bearing pin 20. The bottom portion 18 and the leg portions 19 define a channel extending the entire length of the trigger lever 16. The bottom portion 81 is cut out on its front region adjacent to the cylinder housing 11*a* so that a recess or opening 22 is formed therein.

The safety mechanism 17 includes an actuating portion 23 which is accommodated by the channel (not shown) in the trigger lever 16. The safety mechanism 17 is formed of flat material and has a safety extension portion 24 extending into and through the recess 22 which is bent approximately at right angles with respect to the actuation portion 23. The width of the actuation portion 23 is dimensioned to be such that the latter may easily move inside the channel of the trigger lever 16 but in such a manner that it is, on the other hand, safely guided by the leg portions 19, when it slides on the bottom portion 18. A tension spring 25 is provided and fastened at the free end of the actuation portion 23 in the manner shown in FIG. 3. The tension spring 25 is in turn anchored to the end of the bottom portion 18 of the trigger lever 16. Thus, the safety mechanism 17 is constantly biased in a directly towards the at rest-off position, as shown in FIG. 2. The safety extension portion 24 limits the adjustment by abutment against bottom portion 18, so that in the position as shown in FIG. 2 an opening 26 in the actuation portion 23 is aligned with a depression or recess 27 in the bottom of the bottom portion 18 of the trigger lever 16. In such a position, the recess and opening in the trigger lever and the actuation portion, respectively, are properly aligned with the release pin 15 and the driving apparatus may not be actuated upon depression of the trigger lever.

When the safety mechanism 17 is in the position, as shown in FIG. 3, the recess 27 and the opening 26 are misaligned, and upon depression of trigger lever 16, the release pin 15 is engaged and the driving apparatus 10 is energized to propel a fastener into the workpiece.

If the trigger lever 16 or the safety mechanism 17 of the driving apparatus 10 is not actuated, the mechanism will be in the position, as shown in FIG. 2. The pivotal movement of the trigger lever 16 alone leads the release pin 15 to enter into the opening formed by the opening 26 and the recess 27, without actuating the apparatus and the compressed apparatus will not be energized.

However, with the aid of the back of the forefinger engaging the safety extension portion 24 in the direction of the arrow 28, the safety mechanism 17 is brought into the position, as shown in FIG. 3. The opening 26 will no longer be disposed above the recess 27, so that a pivotal movement of the trigger lever 16 in the direction of the arrow 29 will lead the upper surface of the actuation portion 23 to engage the release pin 25, now being in a position to actuate the apparatus in order to release a fastener.

Thus, while I have described the invention is connection with specific embodiments, it is to be understood that these are capable of variation and modification, and I do not wish to be limited to the precise details set forth, but desire to avail myself of such changes and modifications as fall within the purview of the appended claims.

I claim:

1. A safety release mechanism for a power operated fastener driving apparatus having a shooting channel for the fastener and a pivotally supported trigger lever housing for actuating a release pin of the driving apparatus, including in combination:

the trigger lever housing comprised of a trigger lever portion having bottom and side portions thereon and defining a channel therein with said bottom portion having a recess therein and wherein said side portions are pivotally attached to the driving apparatus for pivotal movement of said trigger lever into engagement for actuating the release pin, said safety release mechanism having an actuation portion slidably positioned within said channel and an extension portion extending outwardly from said bottom portion of said trigger lever housing, with said actuation portion having an opening therein, spring means engageable with said actuation portion to bias the same to an at rest-off position wherein said opening therein and said recess in said bottom of said trigger lever housing are in aligned position to receive the release pin and prevent actuation of the driving apparatus, and wherein said extension portion of said safety release mechanism is engageable and movable upon the pivotal movement of said trigger lever housing from said at rest-off position to a second position wherein said opening in said actuation portion and said recess in said bottom portion of said trigger lever housing are misaligned to permit engagement of the release pin by the trigger lever housing to energize the driving apparatus.

2. The safety release mechanism in accordance with claim 1 wherein said actuation portion and said extension portion are one-piece and are substantially L-shaped and said safety mechanism is formed of a flat strip of sheet metal material.

3. The safety release mechanism in accordance with claim 1 wherein said extension portion is slightly bent away from the axis of the shooting channel of the driving apparatus.

4. The safety release mechanism in accordance with claim 2 wherein the length of said extension portion substantially corresponds to the thickness of a finger.

5. The safety release mechanism in accordance with claim 2 wherein the width of said actuation portion substantially corresponds to the width of the channel of the trigger release lever housing.

6. The safety release mechanism in accordance with claim 2 wherein said extension portion is movable in a recess defined at the bottom of the trigger lever housing.

7. The safety release mechanism in accordance with claim 2 wherein said extension portion when in the at rest-off position lies against an abutment on the trigger lever housing.

8. The safety release mechanism in accordance with claim 1 wherein said spring means is anchored to the free end of the trigger lever housing.

9. The safety release mechanism in accordance with claim 8 wherein said channel of said trigger lever housing extends approximately the entire width of the trigger lever and covers said spring means.

* * * * *